United States Patent [19]

Torbenson

[11] 4,232,906

[45] Nov. 11, 1980

[54] MACHINE FOR STRIPPING SHINGLES

[76] Inventor: Dale A. Torbenson, Hensel, N. Dak. 58241

[21] Appl. No.: 26,331

[22] Filed: Apr. 2, 1979

[51] Int. Cl.[3] ..... E04D 15/00

[52] U.S. Cl. ..... 299/39; 15/93 R

[58] Field of Search ..... 299/39; 172/708, 45, 172/96; 15/93 R

[56] References Cited

U.S. PATENT DOCUMENTS

| | | | |
|---|---|---|---|
| 1,415,949 | 5/1922 | Perelman | 299/39 |
| 1,830,565 | 11/1931 | Schaeffers | 172/96 X |
| 2,749,103 | 6/1956 | Clemenzi | 299/39 |
| 2,801,432 | 8/1957 | Randrup | 15/93 R |
| 3,223,451 | 12/1965 | Orr | 299/39 X |

FOREIGN PATENT DOCUMENTS

| | | | |
|---|---|---|---|
| 2136147 | 2/1973 | Fed. Rep. of Germany | 299/39 |

*Primary Examiner*—Ernest R. Purser

[57] ABSTRACT

A machine for stripping shingles from a surface, the machine comprising a frame having a handle portion and first and second leg portions, an axle mounted on the leg portions and extending therebetween, first and second wheels mounted on the axle, a motor mounted on the frame, a drive mechanism interconnecting the motor and the axle, and cutter assemblies fixed to the axle, each of the cutter assemblies comprising a base portion fixed to the axle, a coil spring portion connected to the base portion and extending outwardly therefrom, and a cutter portion connected to the spring portion and extending outwardly therefrom.

7 Claims, 4 Drawing Figures

MACHINE FOR STRIPPING SHINGLES

BACKGROUND OF THE INVENTION

1. Field of the Invention

This invention relates to devices for stripping shingles from surfaces and is directed more particularly to a machine for stripping shingles.

2. Description of the Prior Art

When it is desired to reshingle surfaces, particularly surfaces having asphalt shingles and the like, it is desirable to first strip away the old shingles before applying new shingles. It is common practice in stripping away the old shingles to utilize manual tools, such as spade devices, for prying up the old shingles and manually removing them from the surface. It would be desirable to provide a machine which is self-propelled and operates to strip away the old shingles, leaving exposed the basic structure of the surface, generally prepared to receive a new layer of shingles.

SUMMARY OF THE INVENTION

It is, therefore, an object of the present invention to provide a machine for stripping shingles from surfaces.

With the above and other objects in view, as will hereinafter appear, a feature of the present invention is the provision of a machine for stripping shingles, the machine comprising a frame having a handle portion and first and second leg portions, an axle mounted on the leg portions and extending therebetween, first and second wheels mounted on the axle, motor means mounted on the frame, drive means interconnecting the motor means and the axle, and cutter assemblies fixed to the axle, each of the cutter assemblies comprising a base portion fixed to the axle, a coil spring portion connected to the base portion and extending outwardly therefrom, and a cutter portion connected to the spring portion and extending outwardly therefrom, whereby operation of the motor causes rotation of the axle and thereby rotative movement of the cutter assemblies, the cutter assemblies being further caused to move radially in response to centrifugal forces and the counterforce of the spring portion.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
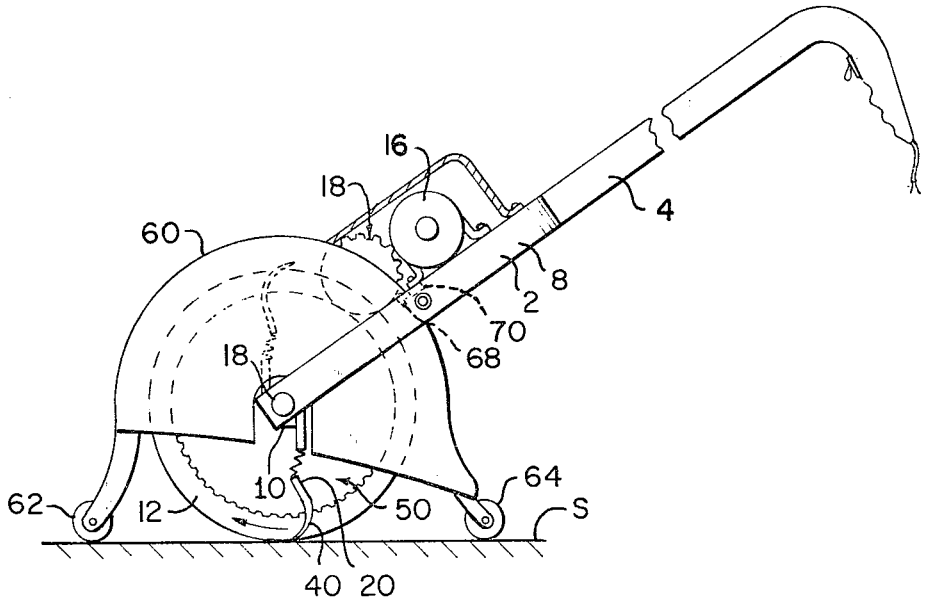
FIG. 1 is a side elevational view, partly in section, showing one form of machine illustrative of an embodiment of the invention.

Referring to the drawings, it will be seen that the illustrative embodiment includes a frame 2 having a handle portion 4 and first and second leg portions 6, 8. An axle 10 is mounted on the leg portions of the frame and extends therebetween. First and second wheels 12, 14 are rotatably mounted on the axle 10 and support the frame on a given surface S. A motor 16 is mounted on the frame, along with drive means, preferably a gear train assembly 18, interconnecting the motor 16 and the axle 10.

Figure 4:
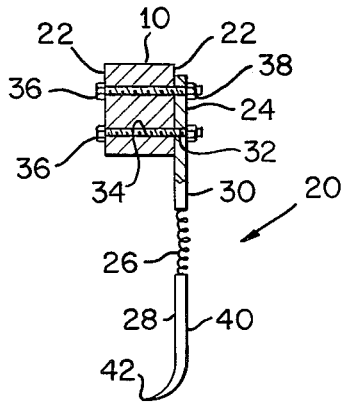
FIG. 4 is an enlarged, detailed elevational and partly sectional view of a cutter assembly.

Cutter assemblies 20 are fixed to the axle 10, which is preferably square in cross-section along a central portion thereof, providing flat surfaces 22 (FIG. 4) for the mounting of the cutter assemblies. Each of the cutter assemblies includes a base portion 24, a spring portion 26 extending from the base portion, and a cutter portion 28 extending from the spring portion.

The cutter assembly base portion comprises a block 30 having holes 32 therein aligned with bores 34 in the axle 10. Bolts 36 and nuts 38 secure the blocks 30 to the axle 10. The spring portion 26 is preferably a coil spring, as shown in the drawings. At the end of the spring portion 26 remote from the block 30 there is fixed the cutter portion 28 which comprises an elongated curved blade 40 having at its outer extremity a cutting edge 42.

Figure 2:
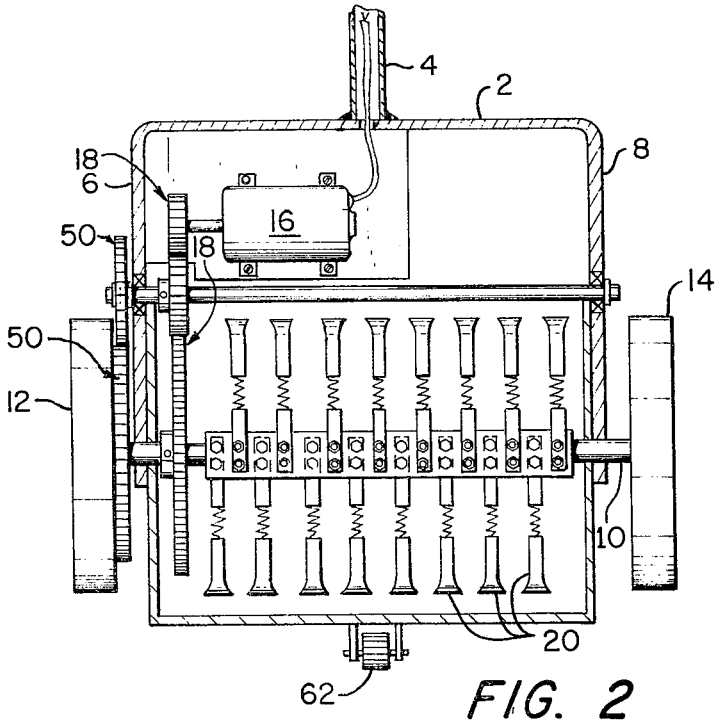
FIGS. 2 and 3 are top plan views of the machine, partly cut away for clarity.
Figure 3:
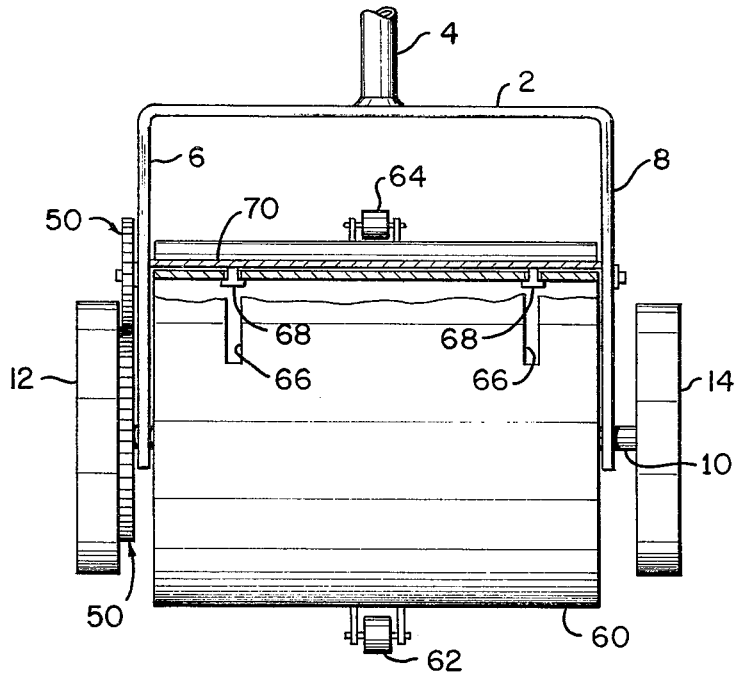

A second drive means, preferably a gear train assembly 50 (FIG. 2), interconnects the first drive means 18 and the first wheel 12, which operates as a drive wheel. The first and second drive means 18, 50 operate to rotate the axle 10 and the drive wheel 12 in response to operation of the motor 16, but at different speeds, so that the rotation of the axle 10 occurs at a more rapid pace than rotation of the drive wheel 12. Thus, as the wheels turn slowly to move the machine across a selected surface, the axle turns rapidly to subject the surface to the action of multiple passes of the blades 40.

At rest, the blades 40 are disposed slightly above the surface S. However, upon rotation of the axle 10, and thereby the cutter assemblies 20, the spring portions 26 extend in response to centrifugal force, allowing the blades 40 to move outwardly and engage the surface S (FIG. 1), the cutting edges 42 taking a cut out of the surface upon each pass. Rotation of the drive wheel 12 moves the machine across the surface S, the machine being guided manually by the handle portion 4.

Upon dulling, the cutter assemblies 20 may be replaced and the operation continued while the dulled blades are being sharpened. The bolts and nuts 36, 38 facilitate quick and easy replacement of the cutter assemblies.

Preferably, the machine is provided with a cover 60 forming a housing disposed about the cutter assemblies. Forward and back wheels 62, 64 are fixed to forward and rearward portions, respectively, of the cover 60 to provide stable four-point support for the machine. The cover may be provided with slots 66 which receive T-shaped protrusions 68 extending from a crossbar 70 mounted on the frame 2. The legs 6, 8 are rotatably mounted on the axle 10, so that within the limits imposed by the protrusions 68 and slots 66, the handle portion of the frame may be pivotally moved about.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A machine for stripping shingles from a surface, said machine comprising a frame having a handle portion and first and second leg portions, an axle mounted on said leg portions and extending therebetween, a portion of said axle between said leg portions being rectangular in cross-section configuration, first and second wheels mounted on said axle, motor means mounted on said frame, drive means interconnecting said motor means and said axle, and cutter assemblies fixed to said axle, each of said cutter assemblies comprising a base block portion comprising a flat plate adjacent and fixed to a flat surface of said axle, a coil spring portion connected to said base portion and extending outwardly therefrom, and a cutter portion connected to said spring portion and extending outwardly therefrom, whereby operation of said motor causes rotation of said axle and thereby rotative movement of said cutter assemblies, said cutter assemblies being further caused to move radially in response to centrifugal and counterforces of and acting upon said coil spring portion.

2. The invention according to claim 1 including second drive means interconnecting said drive means and a first of said wheels, whereby operation of said motor causes rotation of said wheel.

3. The invention according to claim 2 in which said drive means and said second drive means comprise gear train assemblies.

4. The invention in accordance with claim 1 in which said cutter portion comprises an elongated blade curved at its free end and having at its outer extremity a cutting edge.

5. The invention in accordance with claim 1 in which said cutter assemblies comprise a plurality of assemblies fixed at their base block portions side-by-side to a flat surface of said axle.

6. The invention in accordance with claim 5 in which said base block portions are fixed to two opposite flat surfaces of said axle.

7. The invention in accordance with claim 5 or 6 in which said base block portions are bolted to said axle.

* * * * *